US006112893A

United States Patent [19]

Aubry et al.

[11] Patent Number: 6,112,893

[45] Date of Patent: Sep. 5, 2000

[54] PACKAGING BOX HAVING WEDGING FLAPS

[75] Inventors: Laurent Aubry, Houilles; Philippe Benivay, Asnieres, both of France

[73] Assignee: L'Oreal, Paris, France

[21] Appl. No.: 09/193,870

[22] Filed: Nov. 18, 1998

[30] Foreign Application Priority Data

Nov. 25, 1997 [FR] France ..... 97 14783

[51] Int. Cl.[7] ..... B65D 85/14

[52] U.S. Cl. ..... 206/277; 206/777; 206/784

[58] Field of Search ..... 206/775, 525.1, 206/784, 277, 776, 777, 778; 229/185.1

[56] References Cited

U.S. PATENT DOCUMENTS

| | | | |
|---|---|---|---|
| 3,270,867 | 9/1966 | Hennessey et al. | 206/277 |
| 3,344,911 | 10/1967 | Wolowicz et al. | 206/277 |
| 3,360,118 | 12/1967 | Hanson et al. | 206/277 |
| 3,378,137 | 4/1968 | Stone | 206/277 |
| 3,400,879 | 9/1968 | O'Brien . | |
| 3,592,338 | 7/1971 | Hanson | 206/775 |
| 3,684,085 | 8/1972 | Desmond . | |
| 3,746,156 | 7/1973 | Austin, Jr. et al. | 206/277 |
| 3,750,870 | 8/1973 | Cote | 206/277 |
| 3,819,035 | 6/1974 | Jaeschke | 206/277 |
| 4,155,445 | 5/1979 | Roccaforte . | |

FOREIGN PATENT DOCUMENTS 2740112 4/1997 France .

*Primary Examiner*—Paul T. Sewell
*Assistant Examiner*—Luan K. Bui
*Attorney, Agent, or Firm*—Oblon, Spivak, McClelland, Maier & Neustadt, P.C.

[57] ABSTRACT

A box for packaging a tubular container whose bottom is formed with a closing line, the container having a width that increases in the direction towards the closing line. The box is obtained by successively folding a blank in a single piece so as to be able to wedge the container inside the box and guide the container during its insertion into the box. To this end, the box has two V-shaped recesses disposed on either side of the object and separated by a distance smaller than the greatest width of the container, the recesses opening out in the vicinity of one of the ends of the box.

6 Claims, 3 Drawing Sheets

PACKAGING BOX HAVING WEDGING FLAPS

BACKGROUND OF THE INVENTION

1. Field of the Invention

The present invention relates to a packaging box, in particular of cardboard or a similar material, intended to accommodate and hold in position an object such as a flexible tube or a tubular bottle during transport and/or during the storage period.

2. Description of the Related Art

Such packaging boxes have long been known for the protection and presentation of products packaged in a tube, such as skin care creams, sun protection creams, toothpastes, dermo-pharmaceutical products, adhesives, mayonnaise, etc. These tubes frequently have a volume considerably smaller than the volume of the package intended for them, requiring a wedging device for holding them in the box during transport and storage.

At present, there are many packaging boxes on the market having a wedging device. In view of the large number of products on the market, packaged in such boxes, their cost must be as low as possible, hence the need for their manufacture to be easily accomplished and capable of automation. For this purpose it is desirable, far as possible, to make these packaging boxes with an integrated wedging device by cutting out a single cardboard sheet, called a blank, and by successively folding the various sides of the box.

Thus, for example, FR-A-2 703 663 discloses a box obtained from a previously cut out and pre-folded cardboard sheet and comprising six sides intended to form the outside of a parallelepiped box, and a plurality of elements attached to one of the external sides of the box and pre-folded cardboard sheet and comprising six sides intended to form the outside of a parallelepiped box, and a plurality of elements attached to one of the external sides of the box and bearing internally against two opposed sides of the packaging. These elements are arranged so as to define a space in which the object to be packed can be wedged.

U.S. Pat. No. 4,155,445 describes a cardboard box folded for packaging a bottle. The bottom of the box is lined by a section provided with an opening, allowing the bottle to be inserted and wedged in the box.

U.S. Pat. No. 3,400,879 describes a box for packaging a radio valve. This box has an internal wedging section provided with a frangible line that breaks when the valve is introduced into the box. Thus two flaps are formed for wedging the valve in the box.

In general, these packaging boxes presently on the market are satisfactory. However, from an industrial point of view, when placing the objects into their packaging, in certain cases according to the shape of the object, automated insertion into the box is not feasible or is only so with difficulty. Moreover, when one wishes to wedge the object in a specified angular position, for example with a view to its presentation, these known boxes are not suitable.

SUMMARY OF THE INVENTION

It is an object of the present invention to produce a packaging box by simple and inexpensive means, the box allowing an object such as a tube shaped container to be automatically inserted therein such that the object is wedged in such a way as to be protected during transport and storage.

It is another object of the invention lies to provide a box allowing the object to be wedged in a specified angular position.

These and other objects are attained by a box for packaging an object, this box being obtained by successive actions of folding a blank in a single piece, the box including flaps for wedging the object therein. The wedging flaps ensure the guidance of the object during its insertion into the box. Such an arrangement makes it possible to insert the object into the box in an automated packaging line, and to position the object inside the box according to a given orientation.

The object to be packaged is, in particular, a tube or a tubular bottle intended to contain a product of a liquid to pasty consistency. Such a tube is generally cylindrical but tapers to a flattened bottom opposite a neck having the dispensing opening. The flattened bottom has two main sides which flare outwardly to two side edges separated by a distance greater than a diameter of the cylindrical part of the tube. The bottom may have a welded, folded or bonded closure line. As compared with a tube, a tubular bottle has a bottom obtained by molding with the rest of the bottle. The body of such a tubular bottle may have a shape such that its greatest width is either at the bottom or on a portion of the body remote from the bottom.

In accordance with the invention, the wedging flaps have two V-shaped recesses disposed on either side of the box at one of the ends of the box, and separated by a distance smaller than the greatest width of the tube. The tube (or tubular bottle) may be fixed in the box both against translation and rotation by the V-shaped recesses. The V-shaped recesses are designed in such a way that the portion of the body of the tube (or tubular bottle) with the greatest width exceeds the spacing of the V-shaped recesses, the side edges of the tube (or tubular bottle) coming to engage with the edges of the V-shaped recesses.

It is, of course, understood that in principle, any other object can be packaged in the box in accordance with the invention, on condition that it has an appropriate shape.

Advantageously, the blank used for forming the box is constituted by a sheet of cardboard, corrugated cardboard, or any other material such as a plastic sheet, appropriately cut out and folded.

According to a preferred embodiment of the invention, the box has a parallelepiped external shape formed by two parallel main sides, two parallel lateral sides and two parallel end flaps, one of which is open for the introduction of the object. The wedging of the object is accomplished by one or two internal flaps orientated parallel to the lateral sides and having the V-shaped recesses open on the side of the open end flap. However, it is also conceivable to make boxes of a prismatic shape. Advantageously, two wedging sections are disposed on either side of the object.

According to an advantageous embodiment, each recess is delimited by two edges situated opposite each other, and substantially forming a V, one of the edges of each recess having an axial height smaller than the other edge forming the recess, and being constituted by two portions forming an angle relative to one another. When two wedging flaps are used, they are disposed inside the box so that they are connected by a median panel delimited by two fold lines, the median panel being adhered against one of the main sides of the box. Each wedging flap, at the edge opposite to that which is joined to the median panel, joins a second flap disposed substantially parallel to the main face of the box, which flap in turn joins a side flap adhered against the internal surface of an associated lateral side of the box.

According to a particular aspect of the invention, one of the main sides, in particular that situated opposite to the median panel, has an open cutout for displaying the object, in particular during the period of presentation on the shelves of the sales outlet. Due to the invention, the object fixed in the box cannot turn around its longitudinal axis, so that the visible part of the object is always presented in the same way. This is important when the object has a logo allowing the user to identify the object.

By appropriately dimensioning the space between a wedging flap and the associated lateral side of the box, it is possible to create a secondary space allowing an accessory or an information notice to be arranged on the object.

The formation of the box in accordance with the invention can be effected on a simple industrial tool, since no complicated folding is necessary during this procedure.

BRIEF DESCRIPTION OF THF DRAWINGS

To render the present invention more readily understood, an embodiment of a packaging box in accordance with the invention will be now described by way of a purely illustrative and in no way restrictive example, represented in the attached drawings, in which.

DETAILED DESCRIPTION OF THE PREFERRED EMBODIMENT

Figure 1:
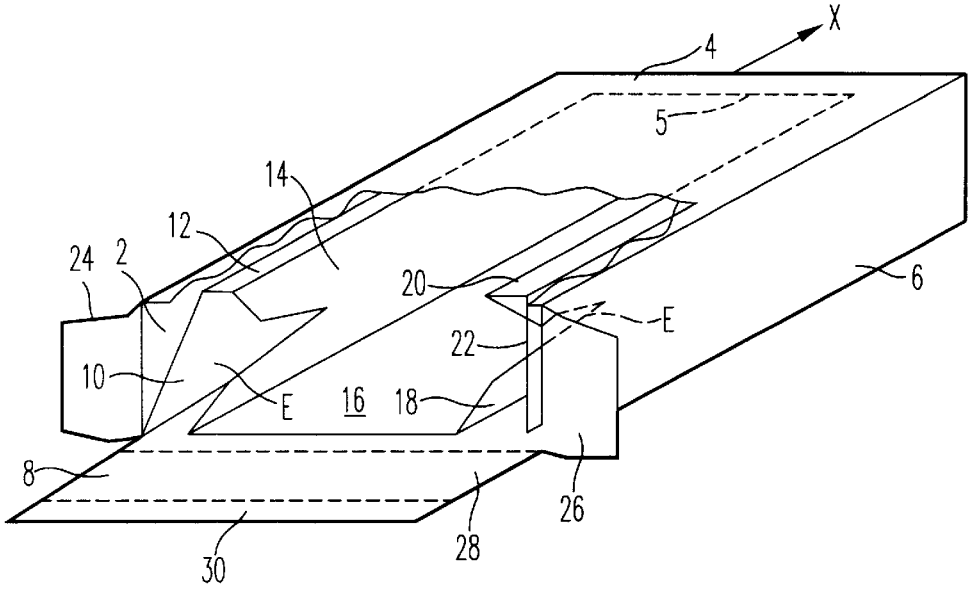
FIG. 1 is a schematic perspective view of the box in accordance with the invention, with a partial stripping of the outer sides.
Figure 2:
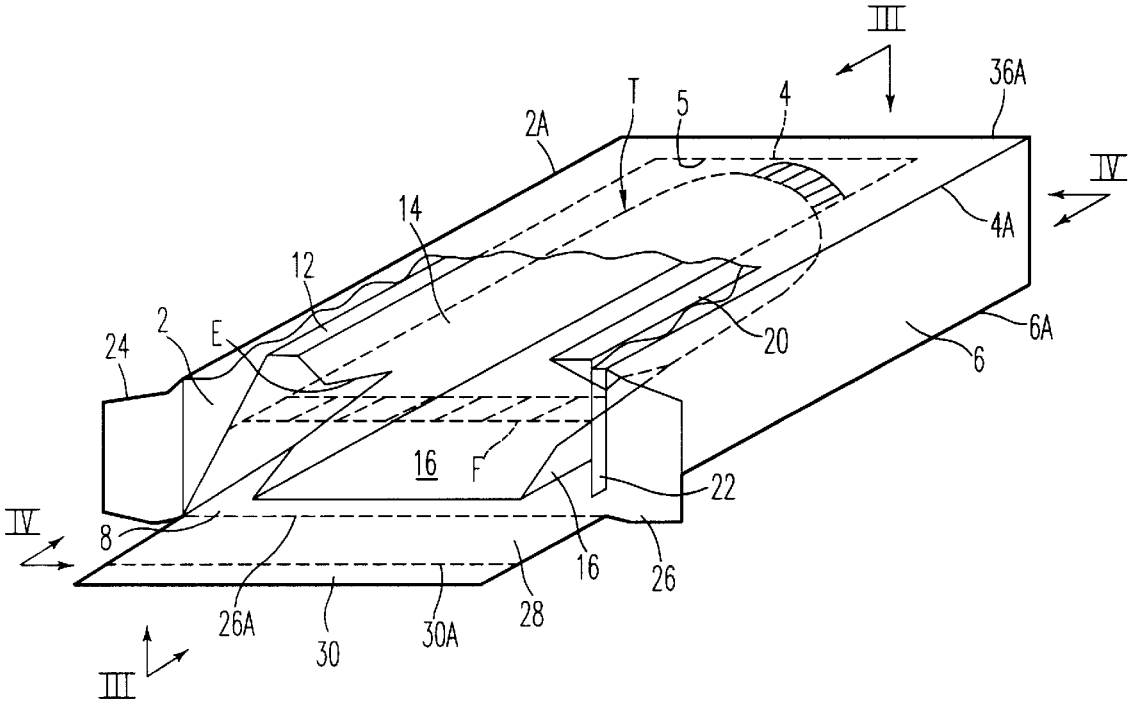
FIG. 2 shows the same view as FIG. 1, but with a tube wedged in the box.
Figure 3:
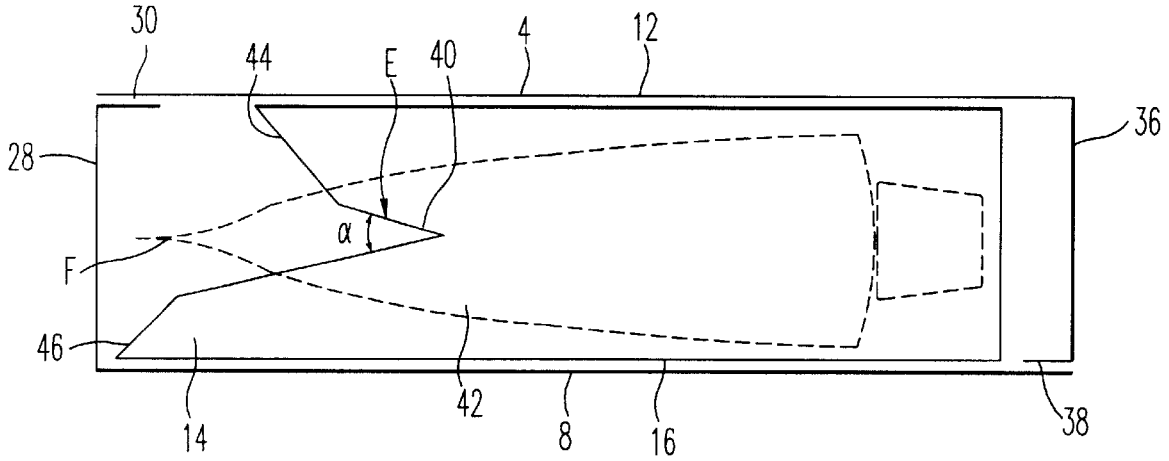
FIG. 3 is a schematic side view of the cross-section along plane III—III of FIG. 2.
Figure 4:
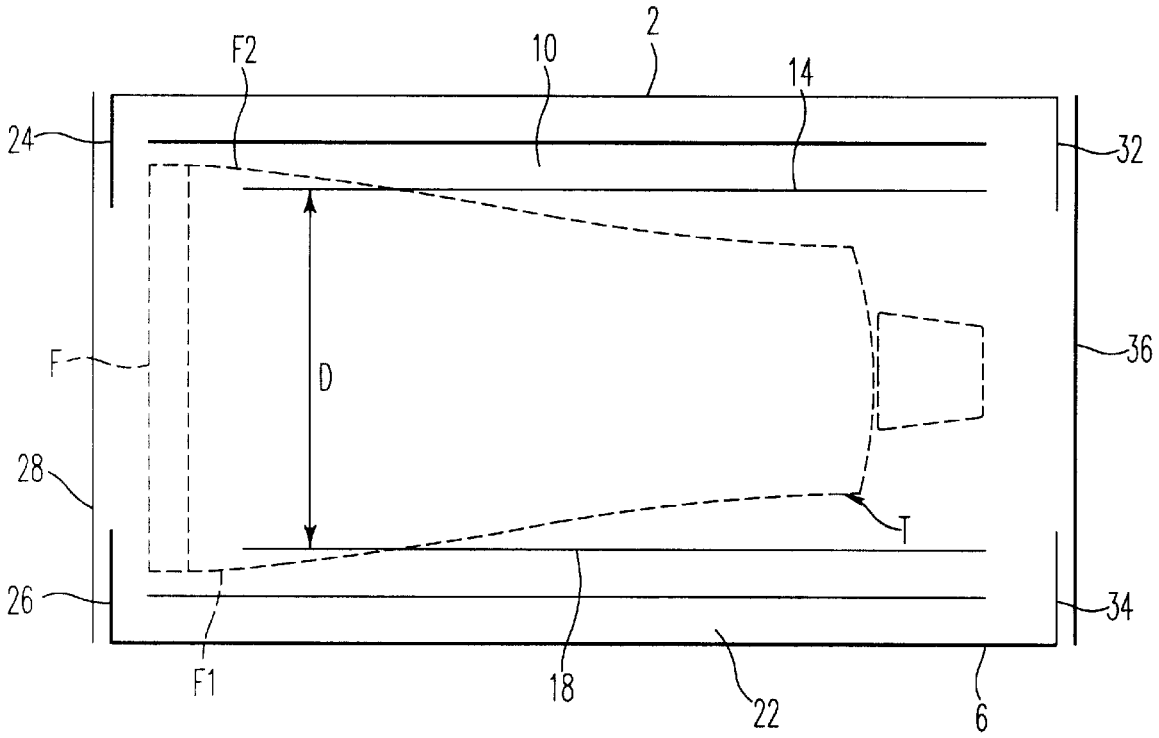
FIG. 4 is a schematic top view of the cross-section along plane IV—IV of FIG. 2.

FIGS. 1 to 4 illustrate a box of a parallelepiped shape and having a longitudinal axis X. The box comprises three pairs of rectangular outer sides, each pair being formed by two parallel sides: two main sides 4, 8, two lateral sides 2, 6 and two end flaps 28, 36 by means of which the box can be opened or closed. The side 4 constitutes the front side, commonly designated by the term "face;" the side 8 on the opposite side to the "face" will be designated hereafter as the "back." One of the end flaps 28 adjoins one of the main sides 8 along a fold line 28*a* (see also FIG. 5). Similarly, the other end flap 36 (see FIG. 5) adjoins the other main side 4 along a fold line 36*a*. The folds 28*a*, 36*a* are situated axially on mutually opposite ends of the main sides 4, 8. Each end flap is provided with a tongue 30, 38, adjoining the respective end flap via a fold line 30*a*, 38*a* parallel to the fold lines 28*a*, 36*a*. Thus a first lateral side 2 adjoins the first (face) main side 4 along a fold line 2*a*. The main side 4 adjoins a second lateral side 6 along a fold line 4*a*. The second lateral side 6 adjoins the second main side 8 (back) along a fold line 6*a*. Beyond the fold line 8*a*, seven internal wedging flaps 10, 12, 14, 16, 18, 20 and 22 successively adjoining one another via parallel fold lines 10*a*–22*a* are attached to the back 8.

When the box is closed, the seven flaps 10, 12, 14, 16, 18, 20 and 22 are not visible and constitute, after being folded inside the box, a part for wedging the object to be packaged. As may be seen in FIGS. 2 to 4, this object may be a tube T having a body closed by a bottom F obtained by squeezing and thermo-welding of the end of the body. It will be seen, in particular in FIGS. 3 and 4, that the bottom F of the tube T is flattened and wider than the rest of the body of the tube. The bottom of the tube has two side edges $F_1$ and $F_2$ which are each accommodated in a slot E cut in the wedging part.

Two of the internal wedging flaps, i.e., 14 and 18, form sections with a slightly smaller width than the width of the lateral side 2, 6 and are situated on either side of the tube T parallel to the said lateral side. The wedging 14, 18 are connected to one another by flap 16 forming a median panel along two fold lines 16*a*, 16*b*. The median panel is fixed, for example, by adhesion to the internal surface of the back 8. On the opposite side to the median panel 16, each one of the sections 14, 18 adjoins a second flap 12, 20 orientated parallel to the face 4. In its turn, each second flap 12, 20 adjoins a flap forming a lateral side 10, 22. The flap 10 is adhered to the internal side of the lateral side 2. The flap 22 which forms the end portion of the wedging device is fixed for example by being adhered to the internal surface of the lateral side 6.

The width of the median panel 16 which determines the distance d between the wedging flaps 14, 18 is substantially greater than the diameter of the tubular body of the tube, and substantially smaller than the distance between the end portions $F_1$ and $F_2$ at the flat bottom of the tube, so that these portions can thus be accommodated in the notches E. According to an important aspect of the invention as may be seen, in particular in FIG. 3, each notch E has edges 40 and 42 diverging in the direction towards the end flap 28, thus defining a V-shaped configuration. The edges 40, 42 form an angle $\alpha$ between them. This end flap 28 will be closed last after the formation of the box and the insertion of the tube. Each V-shaped edge 40 and 42 flares towards the end of the box in a portion 44 and 46 respectively having a greater opening angle than the base of the "V".

When, during the filling operation of the box, it is presented with the closing flap 28 open, the arrangement of the cut-out parts E described above allow the automatic introduction of the tube in a packaging line. During this operation, as the tube advances, the latter automatically takes on the correct orientation as the ends of the portions $F_1$ and $F_2$ of the bottom of the tube are inserted in the recesses E. Thus, during transport or the display of the box in the shop, the tube cannot accidentally change its position.

In the figures, the recesses E are formed by the edges 40, 42, 44, 46 in a "V" of an unequal length. The edge of the "V" at the side of the end flap 28 is longer than the other edge in order to facilitate the insertion of the tube. It is, of course, understood that the edges 40 and 44, and 42 and 46, may each form a straight line and, in this case, be of equal lengths.

Figure 5:
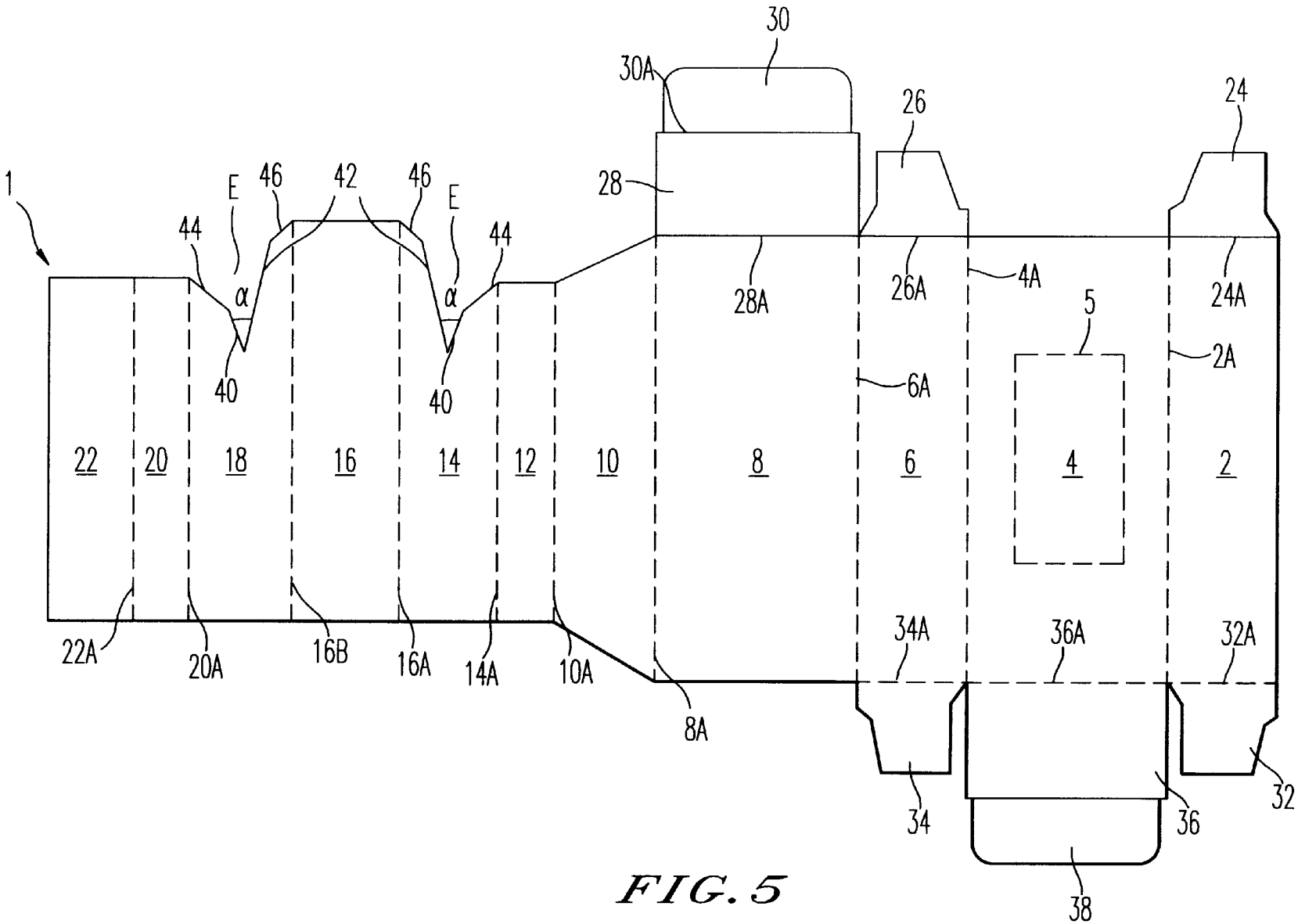
FIG. 5 is a view of the blank of the box of FIG. 1 before folding.

FIG. 5 shows the blank of the box of FIG. 1 before folding, having been appropriately cut out beforehand. It will be seen that each end of each lateral side 2, 6 is extended in a tongue 24, 32 and 26, 34 respectively, which are folded into the box after its formation.

According to this embodiment, to form the box the flaps 14, 16 and 18 are folded into a U shape along the lines 16*a* and 16*b* at an angle of 90°. The flaps 12 and 20 are then folded outwards along the lines 14*a* and 20*a* and the flaps 10 and 22 are folded back parallel to the flaps 12 and 20 along the lines 10*a* and 22*a*. The external surface of the flaps 10, 16 and 22 is then covered with adhesive. By successively folding the outer sides of the box, the back 8 is then adhered onto the median panel 16, the lateral side 6 onto the flap 22 and the lateral side 2 onto the flap 10 in succession. After the tongues 32 and 34 have been folded along the lines 32*a* and 34*a*, the tongue 38 is folded along the line 38*a* and the flap 36 is closed by being folded along the line 36*a*.

The tube T is then inserted into the notches E as described above. After the tongues 24 and 26 have been folded back along the lines 24*a* and 26*a*, the flap 28 is closed by introducing the tongue 30 into the box.

It should be noted that the facing 4 may be provided with a rectangular cutout 5 forming a window and allowing the tube to be displayed when the box is set out on the sales shelves. If required, the window may be covered by a transparent sheet adhered to the internal surface of the facing 4.

Obviously, additional modifications and variations of the present invention are possible in light of the above teachings. It is therefore to be understood that within the scope of the appended claims, the invention may be practiced otherwise than as specifically described herein.

We claim:

1. A box for packaging a generally tubular container having an increased width adjacent one end, the box comprising a single piece blank successively folded to have a closable open end and to have two internal wedging flaps, wherein said wedging flaps are mutually separated by a distance smaller than a maximum width of the container when the box is in a folded state and when the box is in an unfolded state, and wherein each of said wedging flaps has an end adjacent said closable open end, said ends of said wedging flaps including V-shaped recesses shaped and positioned so as to guide the container during insertion of the container into the box and to wedge the container inside the box.

2. The box according to claim 1, wherein the box has a parallelepiped external shape, formed by two parallel main sides, two parallel lateral sides and two parallel end flaps, one of said end flaps being positionable to close said open end, wherein said two wedging flaps are orientated parallel to the lateral sides.

3. The box according to claim 1, wherein each of said recesses comprises two edges situated opposite each other and substantially forming a V shape, one of the edges of each said recess having a smaller axial height than the other edge forming said recess.

4. A box for packaging a generally tubular container having an increased width adjacent one end, the box comprising a single piece blank successively folded to have a closable open end and to have two internal wedging flaps mutually separated by a distance smaller than a maximum width of the container, and wherein each of said wedging flaps has an end adjacent said closable open end, said ends of said wedging flaps including V-shaped recesses shaped and positioned so as to guide the container during insertion of the container into the box and to wedge the container inside the box, wherein the box has a parallelepiped external shape, formed by two parallel main sides, two parallel lateral sides and two parallel end flaps, one of said end flaps being positionable to close said open end, wherein said two wedging flaps are orientated parallel to the lateral sides, further comprising:

a median panel connecting said wedging flaps;

second flaps connected to said wedging flaps and disposed substantially parallel to the main sides; and side flaps connected to said second flaps and each adhered against an internal surface of one of its lateral sides.

5. The box according to claim 4, wherein one of said main sides is situated opposite the median panel and has an open cutout for displaying a container in the box.

6. The box according to claim 5, wherein said median panel is adhered against one of said main sides opposite the open cutout.

* * * * *